US005822899A

United States Patent [19]

Yonenaga

[11] Patent Number: 5,822,899

[45] Date of Patent: Oct. 20, 1998

[54] ADVERTISEMENT DISPLAY DEVICE

[76] Inventor: Itsuro Yonenaga, 33-10, Tonouchi-cho 3-chome, Amagasaki-shi, Hyogo, Japan

[21] Appl. No.: 905,394

[22] Filed: Aug. 4, 1997

Related U.S. Application Data

[63] Continuation-in-part of Ser. No. 672,655, Jun. 28, 1996, abandoned.

[30] Foreign Application Priority Data

Jul. 3, 1995 [JP] Japan ..... 7-006666
Apr. 2, 1996 [JP] Japan ..... 8-079909

[51] Int. Cl.[6] ..... G09F 11/12
[52] U.S. Cl. ..... 40/472; 40/524
[58] Field of Search ..... 40/472, 524–528

[56] References Cited

U.S. PATENT DOCUMENTS

| | | | |
|---|---|---|---|
| 1,872,607 | 8/1932 | Reed | 40/472 |
| 2,099,281 | 11/1937 | Shaw | 40/472 |
| 2,923,079 | 2/1960 | Bouchard | 40/472 |
| 3,187,451 | 6/1965 | Fontaine . | |
| 3,824,721 | 7/1974 | Burns . | |
| 5,018,289 | 5/1991 | Gelman . | |
| 5,138,781 | 8/1992 | Claver . | |

FOREIGN PATENT DOCUMENTS

| | | | |
|---|---|---|---|
| 0 413 372 | 2/1991 | European Pat. Off. . | |
| 1096567 | 12/1966 | United Kingdom | 40/472 |
| 2253733 | 9/1992 | United Kingdom . | |
| 95 02143 | 1/1995 | WIPO . | |

*Primary Examiner*—Cassandra H. Davis
*Attorney, Agent, or Firm*—Wenderoth, Lind & Ponack, L.L.P.

[57] ABSTRACT

An advertisement display device which can display a plurality of frames repeatedly one after another and which incurs less manufacturing and initial costs. By activating a motor, a rotary shaft is rotated. The rotary shaft in turn rotates upper and lower driven sprockets, which in turn upper and lower endless chains. An endless sheet stretched between the endless chains are thus rotated together with the chains. The endless sheet is several times longer than a display area defined in an outer case, and has a plurality of continuously arranged display frames each substantially as long as the display area. Each frame carries one kind of advertisement. By rotating the endless sheet, the ads on the respective frames can be repeatedly displayed one after another.

3 Claims, 12 Drawing Sheets

ADVERTISEMENT DISPLAY DEVICE

This application is a continuation in part of Ser. No. 08/672,655 filed Jun. 28, 1996, now abandoned.

BACKGROUND OF THE INVENTION

This invention relates to an advertisement display device capable of displaying a plurality of advertisements one after another.

An ordinary advertisement board carries a single-frame advertisement made up of letters, pictures and/or photos. There is also known a device capable of displaying a plurality of ads one after another.

For example, there is a device capable of displaying a plurality of ads one after another by rotating a plurality of triangular prisms arranged in a row. Each triangular prism has three sides carrying part of different ads. The first sides of three prisms form a first ado when brought together. By rotating the prisms synchronously, the ads on the first to third sides are displayed repeatedly one after another.

More advanced advertisement boards include a light sign board. It has a display screen made up of many indicating lamps arranged in rows and columns. By selectively turning on and off the respective lamps, different ads can be displayed one after another.

In the case of the display device having triangular prisms, each ad has to be divided into a plurality of parts. It was thus difficult to form display frames. It was also difficult to reduce the cost for preparing ads.

The light sign board has a problem in that the initial cost is high, though it can create a vast variety of patterns.

An object of this invention is to provide an advertisement display device which can display a plurality of frames repeatedly one after another and which incurs less manufacturing and initial costs.

SUMMARY OF THE INVENTION

According to this invention, there is provided an advertisement display device comprising a pair of endless chains, a plurality of pairs of sprockets supporting the endless chains so that the endless chains extend substantially along two opposite side edges of a display area and are folded at least twice behind the display area, a sprocket driving means for driving at least one pair of the sprockets, the pair of the sprockets engaging the pair of endless chains, respectively, an endless sheet provided between the endless chains so as to extend along the endless chains, and a plurality of engaging means provided on the respective endless chains and engaging both side edges of the endless sheet.

More specifically, the endless chains extend in a straight line substantially along two opposite sides of the display area. Behind the display area, the endless chains are folded back so that each endless chain is several times longer than the display area.

The sprocket driving means drives at least one pair of sprockets engaging the respective endless chains to rotate the endless chains.

The endless sheet is provided between and along the endless chains. It is stretched between the endless by engaging its side edges with the engaging means provided on the endless chains.

Since each endless chain is several times longer than the display area, the endless sheet is also several times longer than the display area. It is possible to provide such an endless sheet with a plurality of continuous display frames each substantially equal in length to the display area. By rotating the endless sheet by driving the endless chains, it is possible to display the frames on the sheet repeatedly one after another.

A lighting means may be provided behind the display area to illuminate the frame in the display area.

Each endless chain comprises links coupled together by tubular pins. The engaging means are mounted on different ones of the links. Preferably, each engaging means comprises an engaging piece extending through tubular pins on both sides of each link and secured to each link, and a coil spring that engages the engaging piece and an edge of the endless sheet, thereby coupling the engaging piece to the edge of the endless sheet.

By using such engaging means, both side edges of the endless sheet are coupled to the respective endless chains through the coil springs and the engaging pieces of the engaging means. By adjusting the tensile force provided by the coil springs, it is possible to support even a thin, filmy endless sheet without the possibility of rupture or loosening.

The endless sheet may comprise a plurality of sheet strips or sections connected together by a plurality of fasteners.

To detach such an endless sheet, the fasteners unzipped to separate the sheet strips from each other, and then the sheet strips are removed one by one from the endless chains. To mount the endless sheet, sheet strips are separately mounted between the endless chains. In this state, the sheet strips are connected together by the fasteners. In this way, the endless sheet can be easily replaced with a new one.

The advertisement display device according to this invention is simple in structure and can be manufactured at a low cost. Advertisements can be renewed easily at a low cost simply by replacing the endless sheet with a new one.

Other features and objects of the present invention will become apparent from the following description made with reference to the accompanying drawings, in which:

DETAILED DESCRIPTION OF THE PREFERRED EMBODIMENT

Figure 1:
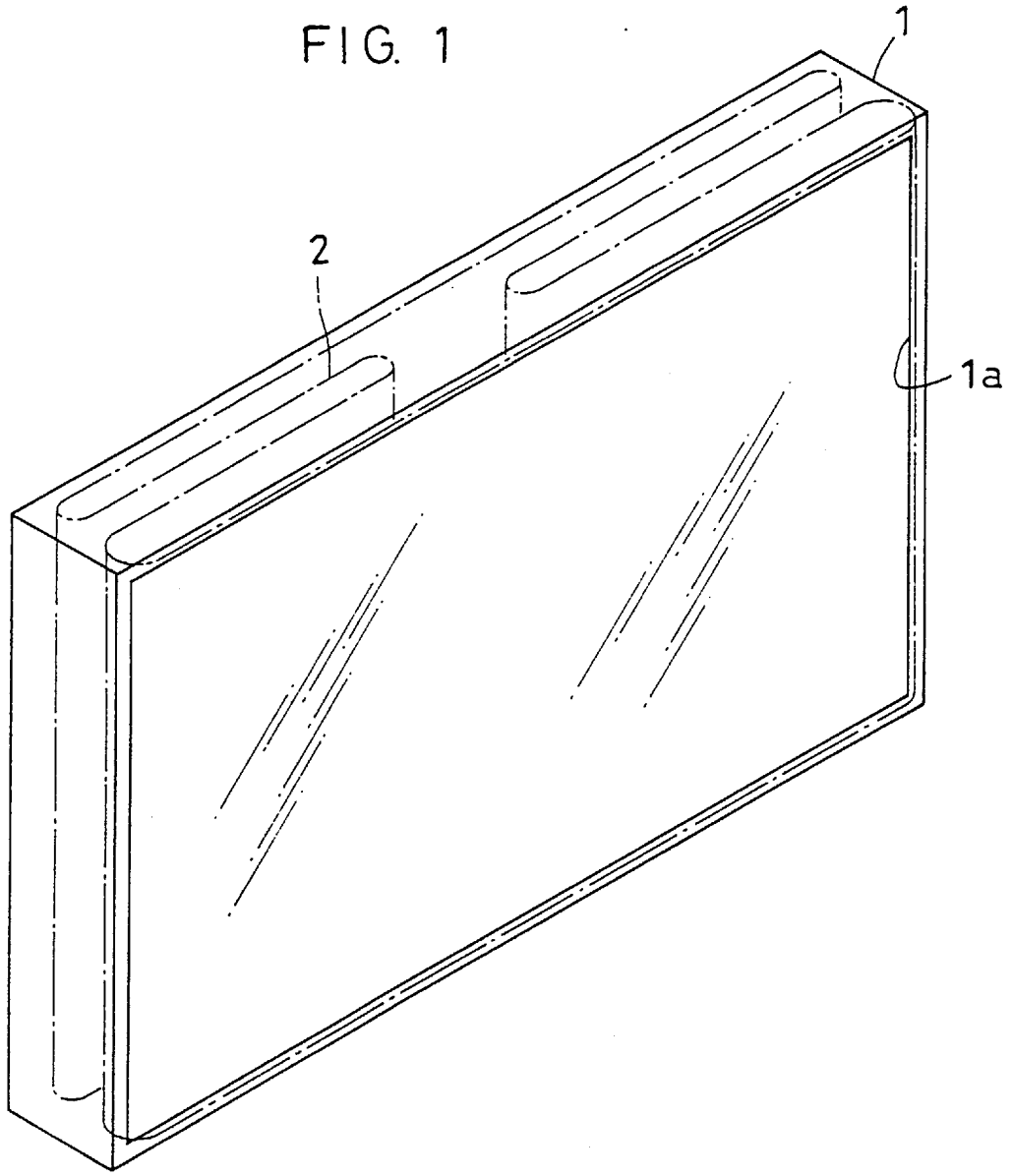
FIG. 1 is a perspective view of one embodiment of the advertisement display device according to this invention.

Now referring to the drawings, the embodiments of this invention are described.

FIGS. 1–6 show the first embodiment of the advertisement display device according to this invention. As shown in FIG. 1, it has a case 1 housing an endless sheet 2 and having a rectangular front opening to form a display area 1*a*. The endless sheet 2 is stretched flat at its portion facing the rectangular display area 1*a* and folded several times behind the rectangular display area 1*a* so that the endless sheet 2 is several times longer than the width of the rectangular display area 1*a*.

Figure 2:
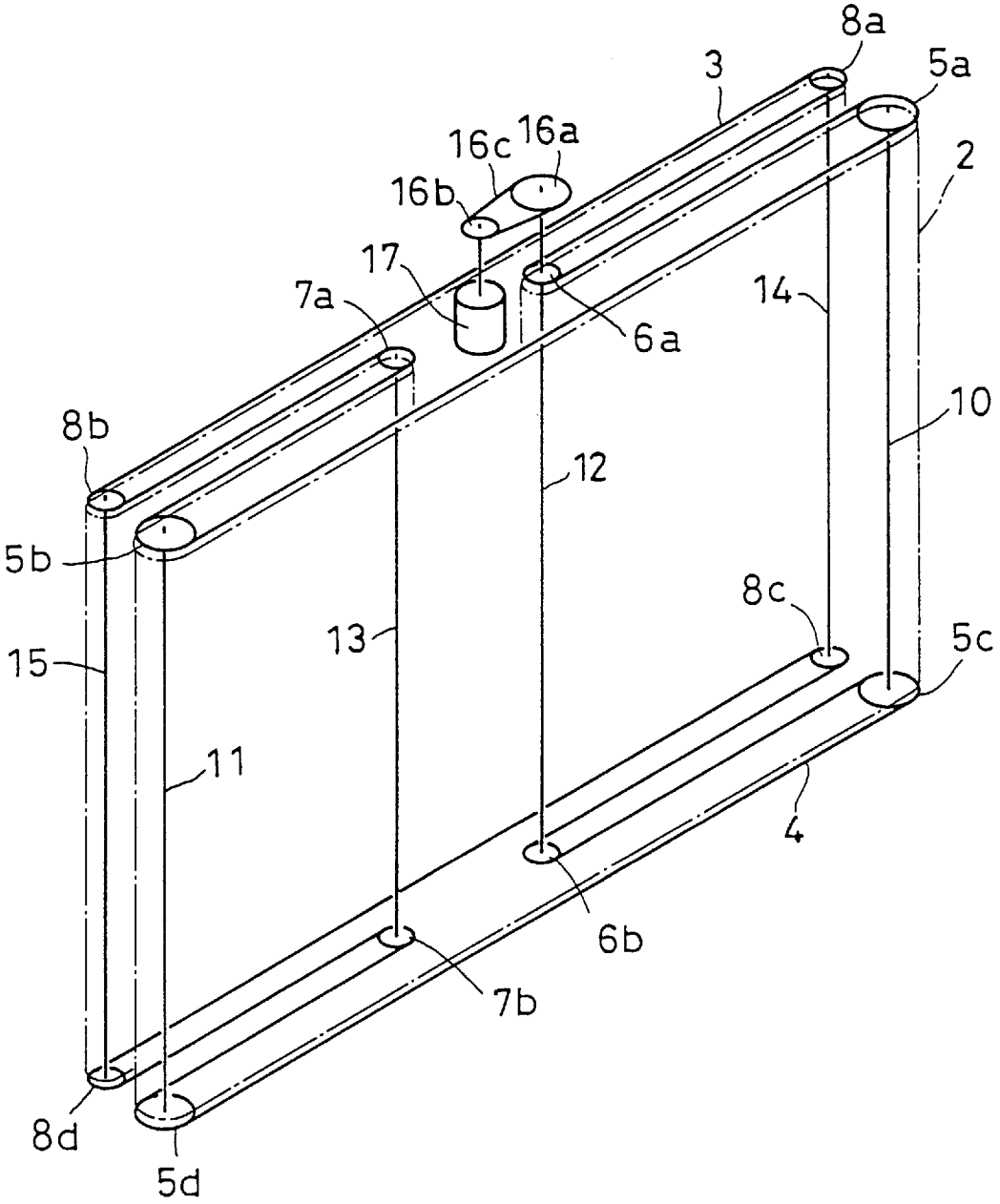
FIG. 2 is a perspective view of the device of FIG. 1, schematically showing its inner structure.

FIG. 2 schematically shows the interior of the case 1. A pair of endless chains 3 and 4 are provided at an upper and lower portions of the case 1, respectively. The upper endless chain 3 extends substantially along the top side of the rectangular display area 1*a*, turns around front sprockets 5*a* and 5*b*, then around a driven sprocket 6*a* and a tension sprocket 7*a*, and then around the sprockets 8*a* and 8*b*. Similarly, the lower endless chain 4 extends substantially along the bottom side of the rectangular display area 1*a*, turns around front sprockets 5*c* and 5*d*, and around sprockets 6*b* and 7*b* and around back sprockets 8*c* and 8*d*.

The upper sprockets a round which the upper endless chain 3 is wound are coupled to the lower sprockets around which the lower endless chain 4 are wound through rotary shafts 10–15.

A driving sprocket 16*a* is fixed to the top end of the rotary shaft 12 that carries the driven sprockets 6*a*, 6*b*. The driving sprocket 16*a* is coupled through a chain 16*c* to another driving sprocket 16*b* fixed to the output shaft of a motor 17. Thus, by activating the motor 17, it rotates the rotary shaft 12, which in turn rotates the driven sprockets 6*a*, 6*b*, which in turn drive the endless chains 3 and 4.

Figure 3:
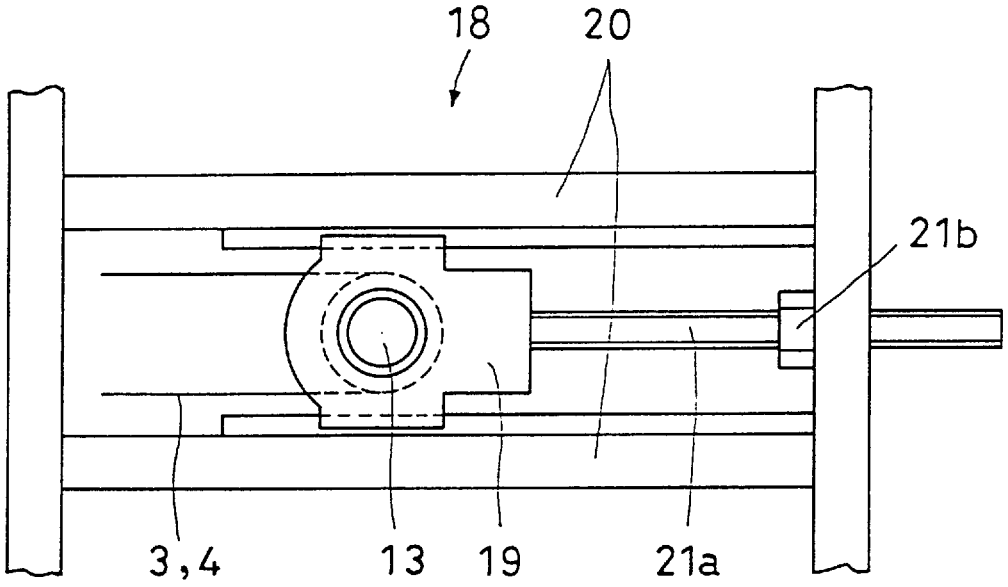
FIG. 3 is a plan view of a tensioning means in the device shown in FIG. 1.

A tensioning device 18 shown in FIG. 3 is provided at each end of the rotary shaft 13 rotatably supporting the tension sprockets 7*a*, 7*b*. Each tensioning device 18 comprises a bearing portion 19 rotatably supporting each end of the rotary shaft 13, guide frames 20 slidably supporting the bearing portion 19, and a bolt 21*a* and a nut 21*b* coupled to the bearing portion 19.

The bearing portion 19 of each tensioning device 18 is slid by turning the bolt 21*a* after loosening the nut 21*b* to adjust the tension in each of the endless chains 3 and 4. After the adjustment, the nut 21*b* is tightened to fix the bearing portion 19 in position and thus to maintain the tension of the chains 3 and 4 at the adjusted level.

Figure 4:
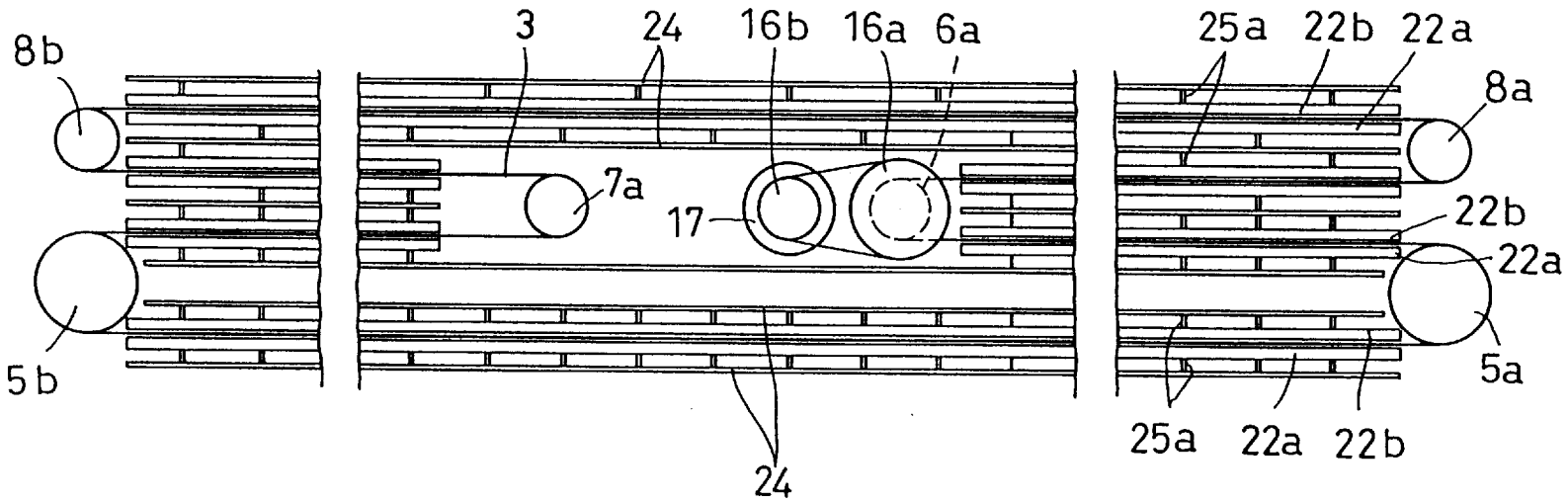
FIG. 4 is a plan view showing the inner structure of the device shown in FIG. 1.

As seen in FIG. 4, the upper endless chain 3 is supported by a plurality of pairs of guide rails 22*a*, 22*b*. Each pair of guide rails 22*a* and 22*b* comprise two square bars made of synthetic resin between which the endless chain 3 can slide.

Figure 5:
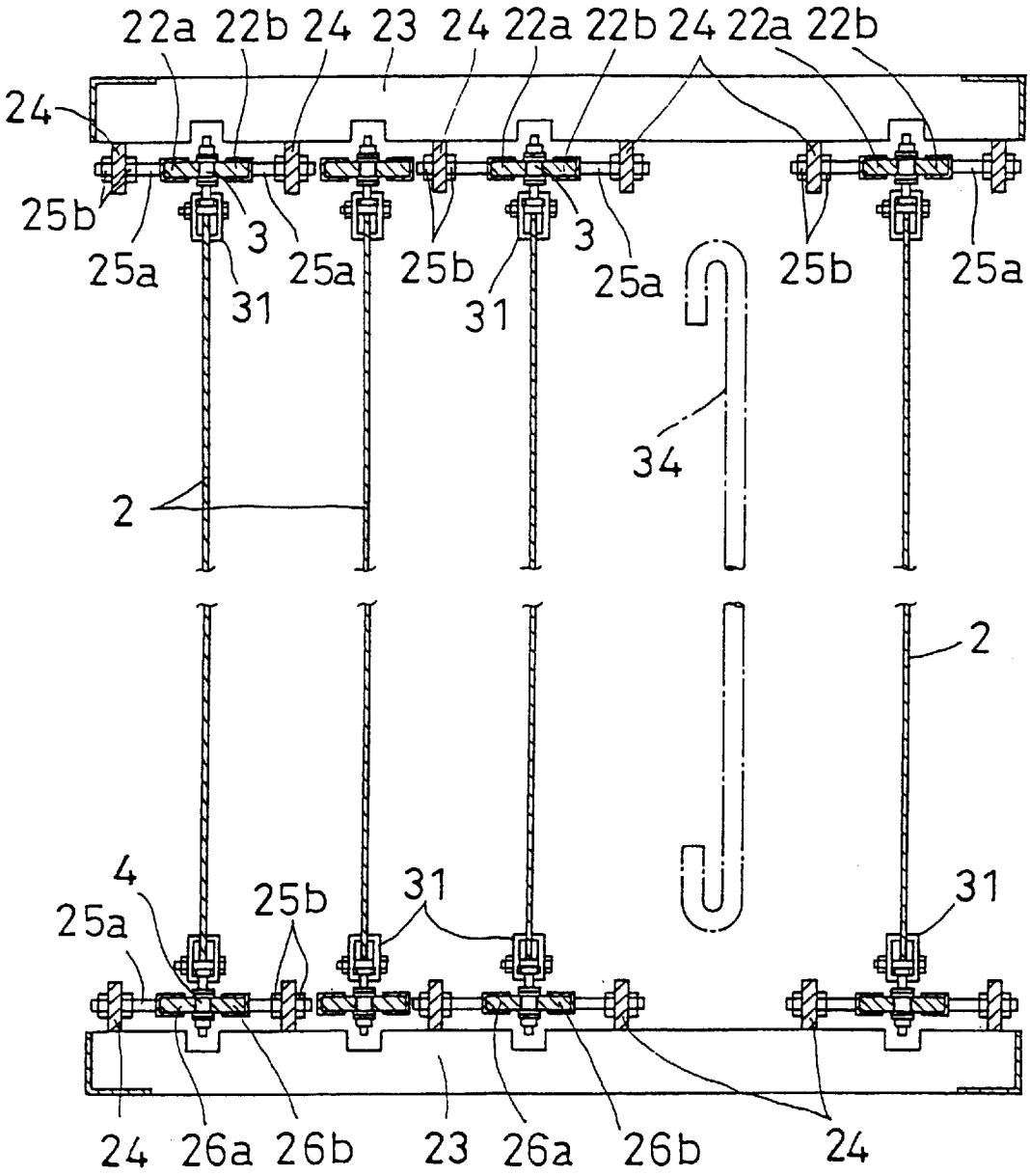
FIG. 5 is a vertical sectional view showing the inner structure of the device of FIG. 1.
Figure 6:
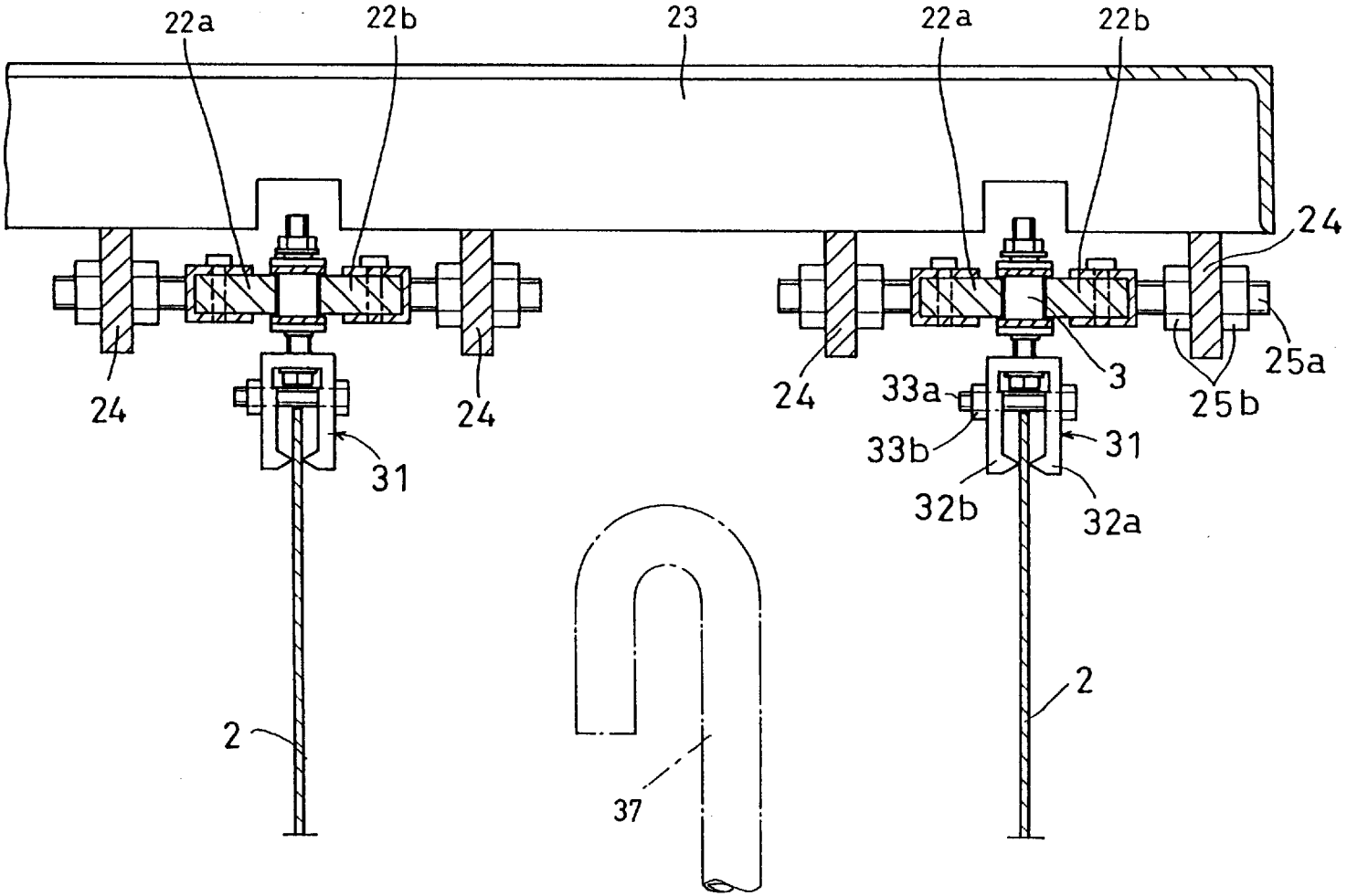
FIG. 6 is a partial enlarged view of FIG. 5.

As shown in FIGS. 5 and 6, the case 1 has an inner frame 23 to which are fixed a plurality of ledges 24. A plurality of bolts 25*a* are coupled to guide sails 22*a*, each bolt extending through the respective ledge 24 and fixed to the ledge 24 by a pair of nuts 25*b*.

By loosening the nuts 25*b* of the bolts 25*a* that couple each pair of guide rails 22*a*, 22*b* to the ledges 24, it is possible to press the guide rails against the endless chain 3 or move them away from the endless chain 3 so that the chain 3 is slidably held between each pair of guide rails 22*a*, 22*b*.

similarly, the lower endless chains 4 are retained between a plurality of pairs of guide rails 26*a*, 26*b*, which are supported by a plurality of ledges 24, bolts 25*a* and nuts 25*b*.

Figure 7:
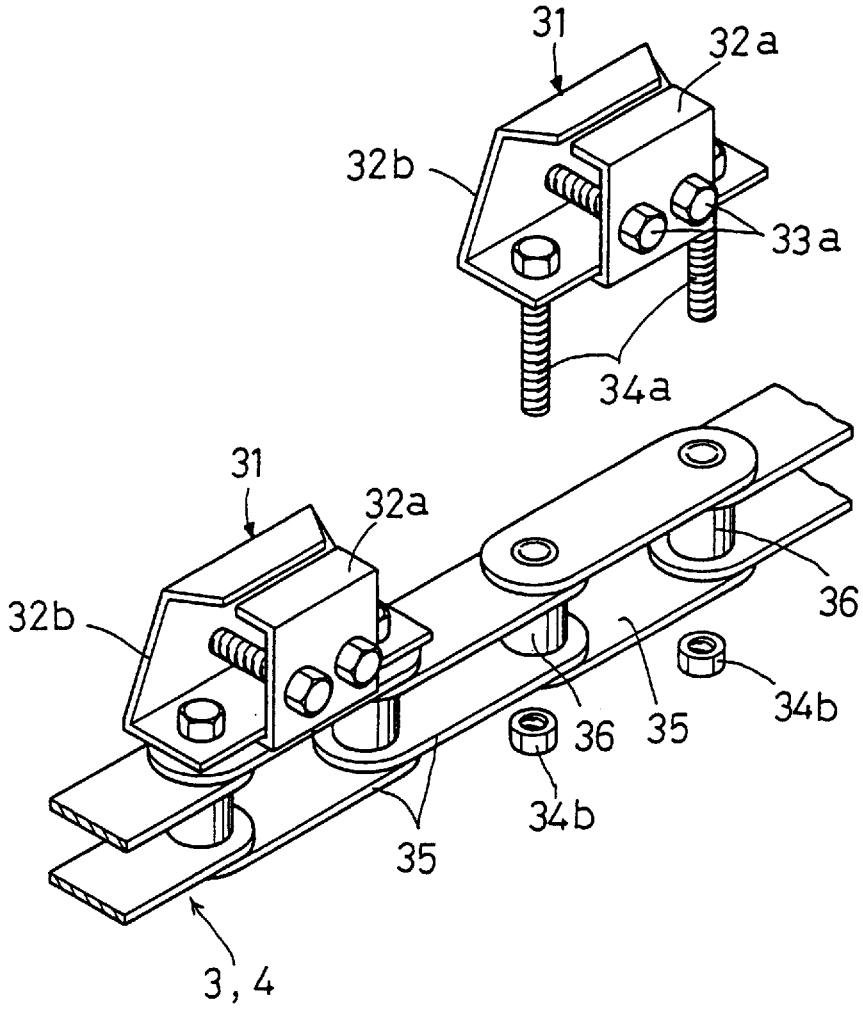
FIG. 7 is an enlarged perspective view showing engaging members and an endless chain of the device of FIG. 1.

As shown in FIG. 7, the upper and lower endless chains 3 and 4 have a plurality of engaging member 31 are made up of links 35 connected together by tubular pins 36. Engaging members 31 are provided on alternate links 35.

Each engaging member 31 has opposite claws 32*a* and 32*b* and is fixed to one of the links 35 by passing bolts 34*a* through holes at both ends of the claw 32*a* and the tubular pins 36 at both ends of the link 35 and tightening nuts 34*b*. With the engaging members 31 secured to the chains 3, 4, the top and bottom edges of the endless sheet 2 are inserted between the claws 32*a* and 32*b* of the engaging members 31, and bolts 33*a* and nuts 33*b* (shown in FIG. 6) are tightened to hold the top and bottom edges of the endless sheet 2 between the claws 32*a* and 32*b*.

The endless sheet 2 is thus stretched between the upper and lower endless chains 3 and 4.

The motor 17 is activated in this state to drive the endless chains 3 and 4. As mentioned earlier, the endless sheet 2 is several times longer than the rectangular display area 1*a* of the case 1, so that it can carry several frames each having substantially the same size as the rectangular display area 1*a*. Thus, by rotating the endless sheet 2 with different advertisements carried on its respective frames, these different ads can be shown repeatedly one after another on the rectangular display area 1*a*.

In the embodiment, the endless sheet is at least four times longer than the rectangular display area 1*a*, so that four different ads can be shown one after another.

The motor 17 may be stopped temporarily every time each frame of the endless sheet 1 moves into the rectangular display area 1*a* to hold the advertisement on each frame at the display area for a while.

A neon lamp 37 may be provided behind the portion of the endless sheet 2 in the rectangular display area 1*a* to illuminate this portion of the sheet 2 from behind.

As compared with a conventional device, the device of this embodiment is simpler in structure and thus can be manufactured at a lower cost. The contents of advertisements can be renewed simply by replacing the endless sheet 2.

Figure 8:
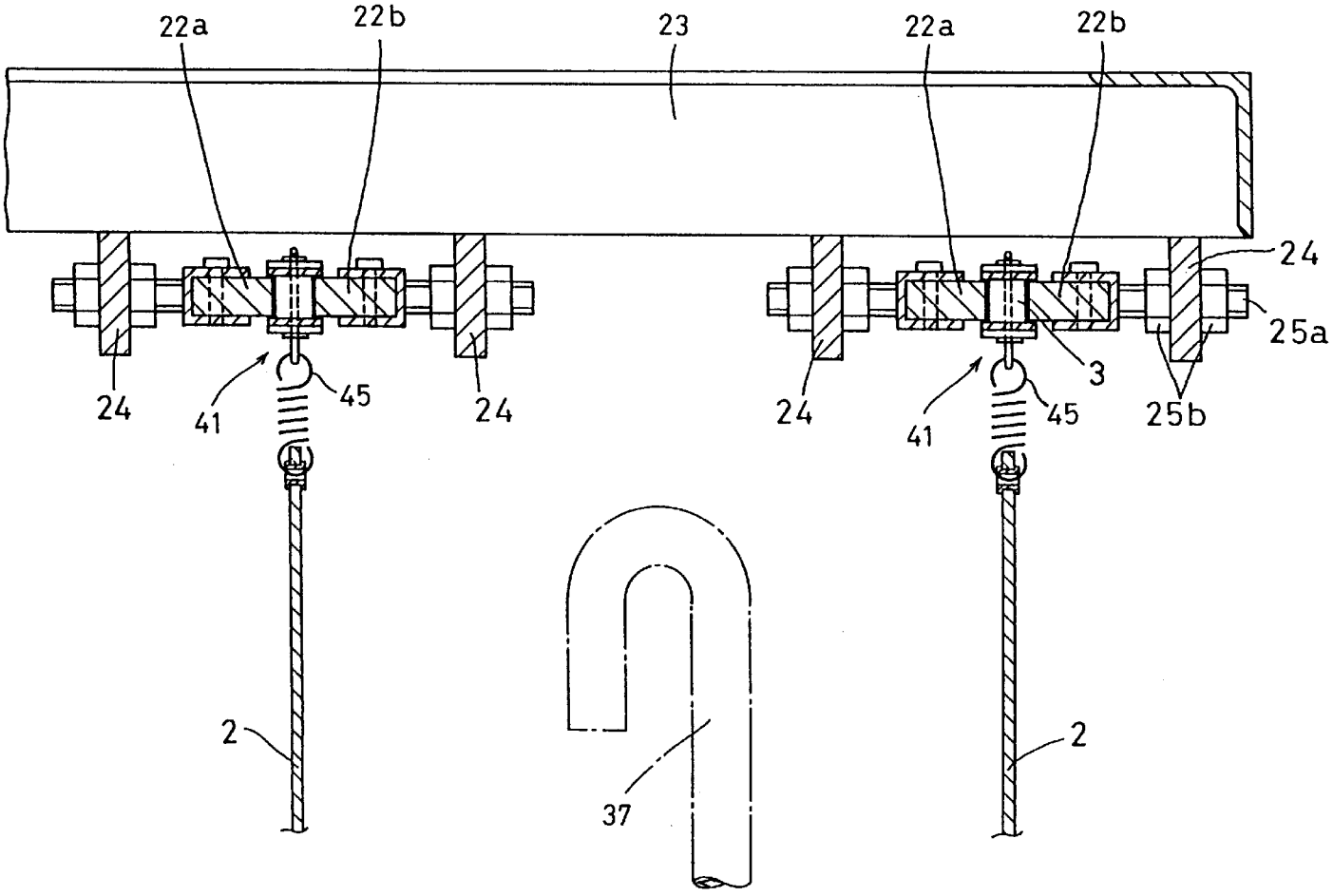
FIG. 8 is a vertical sectional view showing the inner structure of the device having different engaging members.
Figure 9:
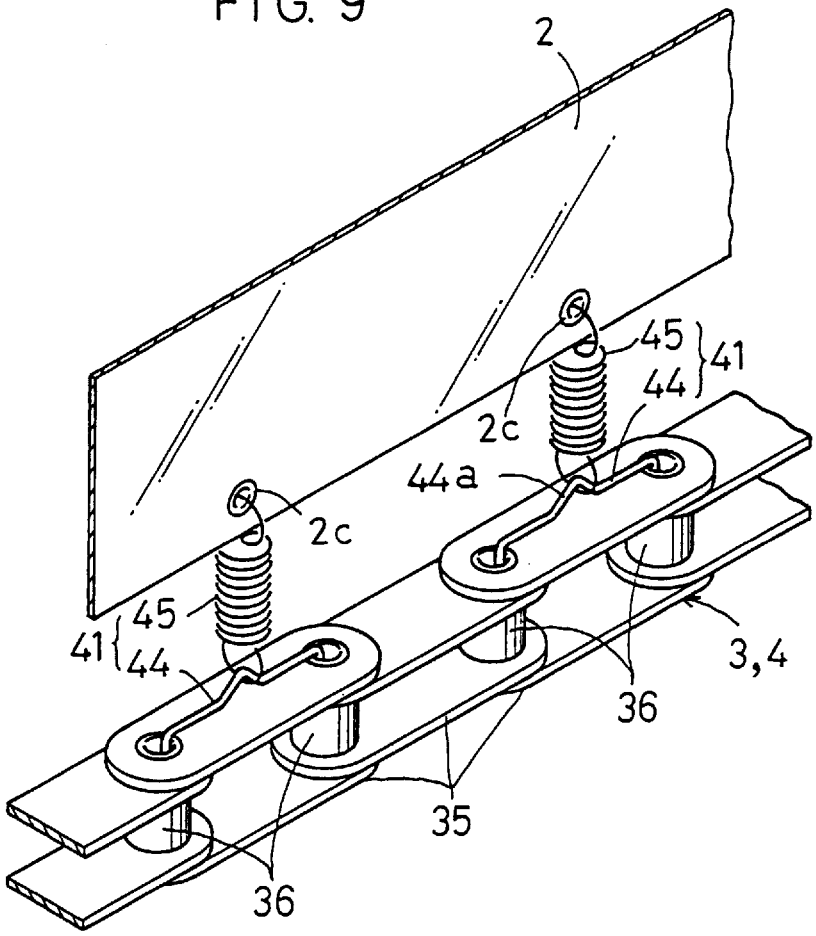
FIG. 9 is a perspective view of different engaging members and an endless chain.
Figure 10:
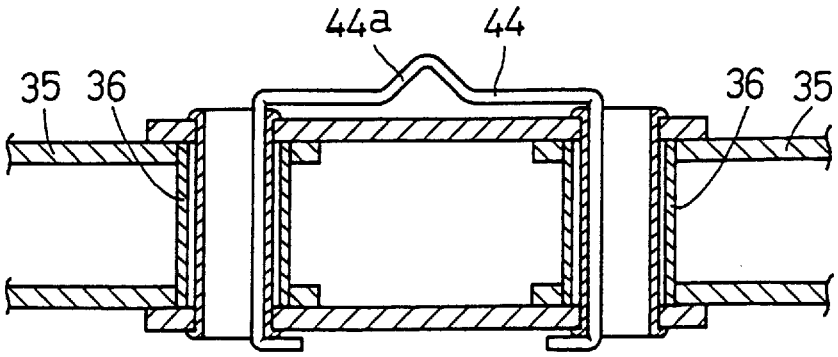
FIG. 10 is a vertical sectional view of FIG. 9.

If the sheet 2 is a thin vulnerable film, engaging members 41 shown in FIGS. 8–10 should be used. Each engaging member 41 has an engaging piece 44 in engagement with the tubular pins 36 on both sides of each link 35, and a coil spring 45 having one end thereof hooked on a bent portion 44*a* of the engaging piece 44 and the other end engaged in an eyelet 2*c* of the endless sheet 2.

The coil springs 45 of the engaging members 41 pull the endless sheet 2 with a suitable tensile force. The endless sheet 2 is thus stretched between the endless chains 3 and 4 without the possibility of rupture or loosening.

Figure 11:
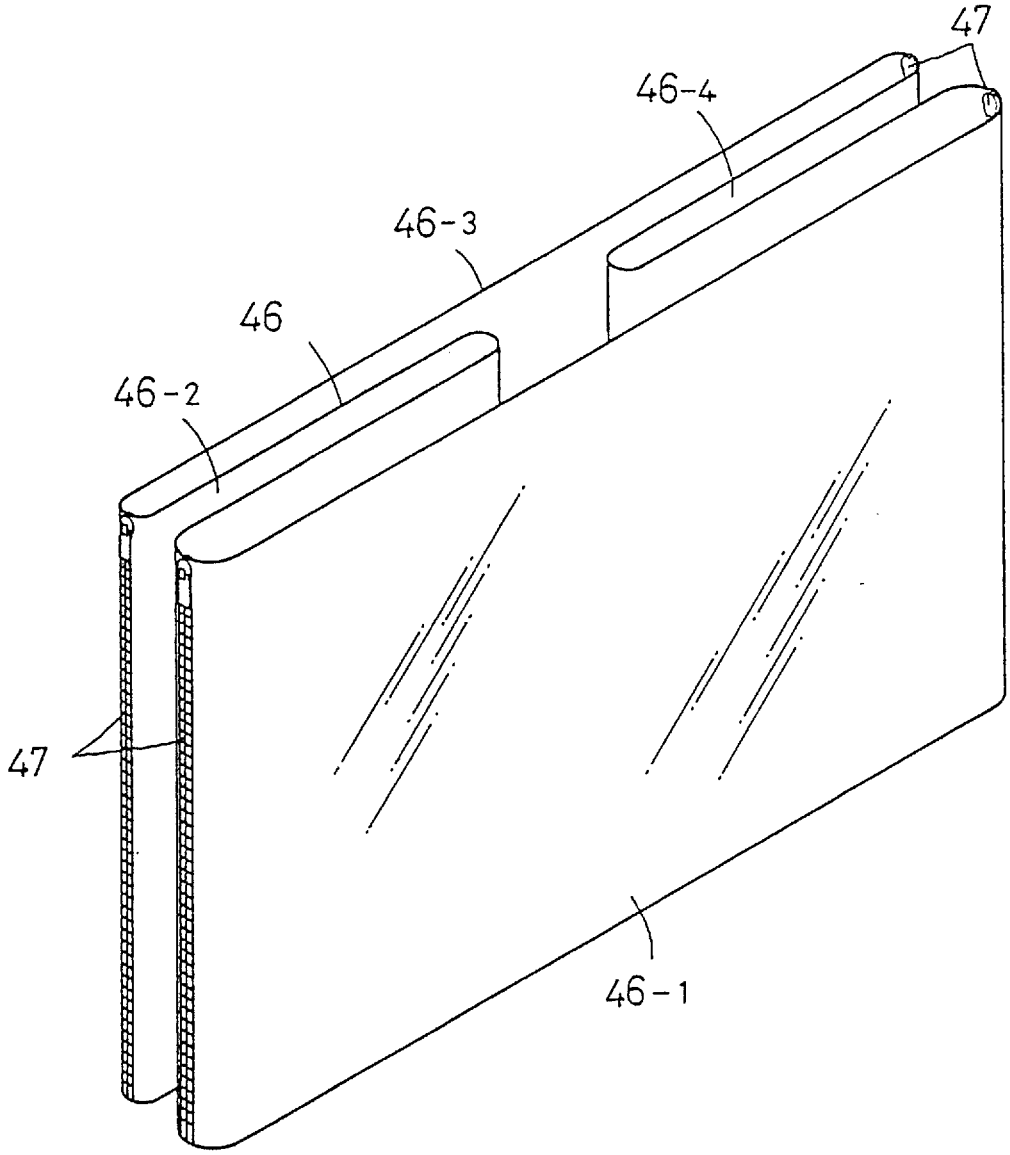
FIG. 11 is a perspective view of an endless sheet of a different type.

An endless sheet 46 shown in FIG. 11 may be used instead of the sheet 2. It comprises four sheet strips 46-1–46-4 that are connected together by four fasteners 47. Each of the sheet strips 46-1–46-4 is slightly larger than the rectangular display area 1*a* and carries one advertisement.

To renew advertisements on the endless sheet 46, the fasteners 47 are unzipped to separate the sheet strips 46-1–46-4 from one another. The thus separated sheet strips 41-1–41-4 are removed one by one from the endless chains 3 and 4 by pulling their top and bottom edges out of the engaging members 31 (or 41).

Then, new sheet strips 46-1–46-4 carrying new ads are stretched one by one between the endless chains 3 and 4 by inserting their top and bottom edges in the engaging members 31 (or 41). In this state, the new sheet strips 46-1–46-4 are connected together by means of the fasteners 47 to form the single endless sheet 46.

When compared with the inseparable endless sheet, the endless sheet of this embodiment can be replaced more simply and easily. Also, it can be replaced more safely and speedily even at high places.

It is possible to replace not all but only one or some of the sheet strips 46-1–46-2. Thus, advertisements can be renewed partially at low cost.

Figure 12:
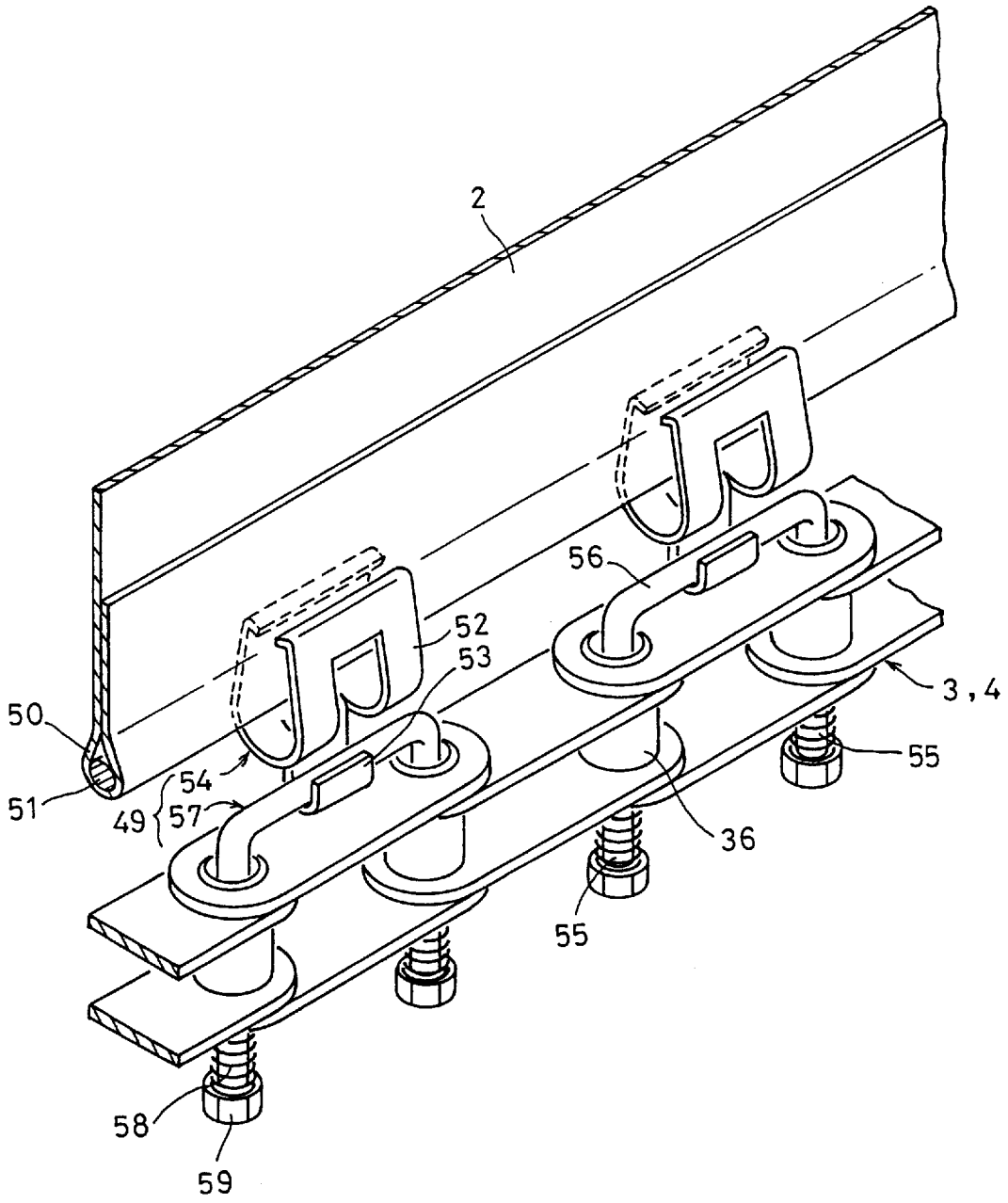
FIG. 12 is a vertical sectional view of a further embodiment.
Figure 13:
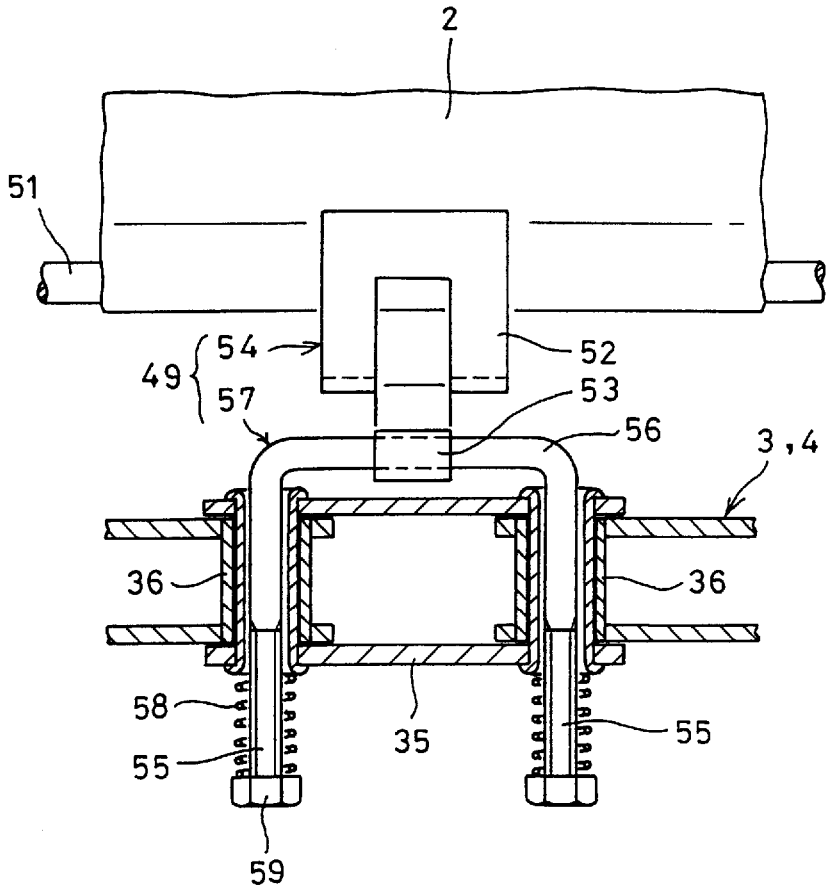
FIG. 13 is a perspective view of the same.

In a further embodiment shown in FIGS. 12 and 13, the endless sheet 2 is connected to the chains 3, 4 by engaging means 49. The endless sheet 2 has bag portions 50 formed by folding its top and bottom edges. A flexible rod 51 is inserted through each bag portion 50. Each engaging means 49 comprises an engaging piece 54 including a clip 52 having a hook 53 at its base end, and an engaging rod 57 having a pair of legs 55 and a bar 56 coupling the legs 55 together.

Each engaging piece 54 is coupled to the endless sheet 2 by holding the rod 51 with the clip 52 from outside the bag portion 50. The engaging rod 57 has its legs 55 inserted in tubular pins 36 formed in each link 35 of the chain 3, 4 at both ends thereof. A coil spring 58 is mounted around the end of each leg 55 protruding downward from the link 35 between a nut 59 threadedly mounted on the leg 55 and the link 35.

By engaging the hooks 53 of the engaging pieces 54 with the coupling rods 56, suitable tension is applied to the endless sheet 2 by the combined force of the coil springs 58. By turning the nuts 59, the tension applied to the sheet 2 can be easily adjusted.

Since the endless sheet 2 is coupled to the chains 3, 4 through the clips 52 having the hooks 53, the sheet 46 can be easily mounted and dismounted.

This invention is not limited to the above-described embodiments but is susceptible to various modifications. For example, the endless sheet may be folded behind the display area in a different manner. Also, the endless sheet may be rotated not horizontally but vertically.

What is claimed is:

1. An advertisement display device comprising:

a pair of endless chains each comprising links coupled together by tubular pins, a plurality of pairs of sprockets supporting said endless chains so that said endless chains extend substantially along two opposite side edges of a display area and are folded at least twice behind said display area, a sprocket driving means for driving at least one pair of said sprockets, said pair of said sprockets engaging said pair of endless chains, respectively, an endless sheet provided between said endless chains so as to extend along said endless chains, and a plurality of engaging means provided on said respective endless chains and engaging both side edges of said endless sheet, each of said engaging means comprising an engaging piece coupled to each of the side edges of said endless sheet and having a hook, an engaging rod comprising a pair of leg portions extending through said tubular pins coupling said links of said endless chains and having free ends protruding from a surface of said respective chain remote from said engaging piece, and a bar portion coupling said leg portions together and detachably coupled to said hook of said engaging piece, nuts mounted on said free ends of said leg portions, and coil springs each mounted around the respective one of said leg portions and having one end thereof engaging said surface of said respective chain and the other end engaging said nut mounted on the free end of each of said leg portions for elastically supporting said sheet.

2. An advertisement display device as claimed in claim 1 further comprising a lighting means provided behind said display area.

3. An advertisement display device as claimed in claim 1 wherein said endless sheet comprises a plurality of sheet sections connected together by a plurality of fasteners.

* * * * *